US012686971B2

(12) United States Patent
Jaakkola et al.

(10) Patent No.: US 12,686,971 B2
(45) Date of Patent: Jul. 21, 2026

(54) METHOD OF CONTROLLING ENZYMATIC ACTIVITIES AND TOOLS RELATED THERETO

(71) Applicant: KEMIRA OYJ, Helsinki (FI)

(72) Inventors: Anu Jaakkola, Espoo (FI); Jaakko Ekman, Espoo (FI); Marko Kolari, Espoo (FI); Markus Korhonen, Espoo (FI)

(73) Assignee: KEMIRA OYJ, Helsinki (FI)

( * ) Notice: Subject to any disclaimer, the term of this patent is extended or adjusted under 35 U.S.C. 154(b) by 431 days.

(21) Appl. No.: 17/996,400

(22) PCT Filed: Apr. 20, 2021

(86) PCT No.: PCT/FI2021/050292

§ 371 (c)(1),
(2) Date: Oct. 17, 2022

(87) PCT Pub. No.: WO2021/214385

PCT Pub. Date: Oct. 28, 2021

(65) Prior Publication Data

US 2023/0220621 A1 Jul. 13, 2023

(30) Foreign Application Priority Data

Apr. 20, 2020 (FI) ..... 20205394

(51) Int. Cl.
*D21C 5/00* (2006.01)
*D21C 5/02* (2006.01)
(Continued)

(52) U.S. Cl.
CPC ..... *D21C 5/005* (2013.01); *D21C 5/02* (2013.01); *D21C 7/12* (2013.01); *D21H 11/14* (2013.01);
(Continued)

(58) Field of Classification Search
CPC . D21C 5/02; D21C 7/12; D21C 5/005; D21H 11/14; D21H 17/11; D21H 17/67;
(Continued)

(56) References Cited

U.S. PATENT DOCUMENTS

2003/0228373 A1* 12/2003 Ludensky ..... A01N 33/04 424/661
2004/0132095 A1* 7/2004 Iizumi ..... C12Q 1/18 435/7.1
(Continued)

FOREIGN PATENT DOCUMENTS

CA 2154944 C * 7/2001 ..... C12N 9/2437
EP 1391430 A1 2/2004
(Continued)

OTHER PUBLICATIONS

Allen et al: "*Cloacibacterium normanense* gen. nov., sp. nov., a novel bacterium in the family Flavobacteriaceae isolated from municipal wastewater", International Journal of Systematic and Evolutionary Microbiology (2006), 56, pp. 1311-1316.
(Continued)

*Primary Examiner* — Abbas Rashid
*Assistant Examiner* — Elisa H Vera
(74) *Attorney, Agent, or Firm* — Meunier Carlin & Curfman LLC

(57) ABSTRACT

The present invention relates to the fields of fibers and uses thereof such as for producing fiber webs, such as paper, board or tissue. Specifically, the invention relates to a method of monitoring and controlling cellulolytic activity in an aqueous cellulose fiber suspension or process water for a production method of a fibrous web containing cellulose fibers. Also, the present invention relates to a method of manufacturing a fibrous web, such as a paper, board, tissue or the like, and use of a biocide for controlling cellulolytic
(Continued)

| | | Mill 1 | | Mill 2 | | Mill 3 | | Mill 4 | | Mill 5 | | Mill 6 | | Mill 7 | | Mill 8 | |
|---|---|---|---|---|---|---|---|---|---|---|---|---|---|---|---|---|---|
| | | WW | RCF | WW | RCF | WW | RCF | WW | RCF | WW | RCF | WW | RCF | WW | RCF | WW | RCF |
| % phylum | Actinobacteria | 12,1 | 24,0 | 12,1 | 9,9 | 7,9 | 10,6 | 1,8 | 1,6 | 0,3 | 0,3 | 7,7 | 7,2 | 0,0 | 0,0 | 4,0 | 3,5 |
| | Bacteroidetes | 60,6 | 60,0 | 42,8 | 44,5 | 44,8 | 44,8 | 75,9 | 74,3 | 19,7 | 21,5 | 42,2 | 39,2 | 1,0 | 0,6 | 35,8 | 41,9 |
| | Firmicutes | 2,2 | 2,2 | 42,1 | 47,3 | 21,5 | 16,7 | 0,7 | 0,5 | 75,5 | 74,0 | 44,5 | 47,7 | 52,9 | 54,5 | 11,2 | 11,8 |
| % order | Corynebacteriales | 14,9 | 19,4 | 11,5 | 0,5 | 4,8 | 5,5 | 0,9 | 0,9 | 0,1 | 0,1 | 4,6 | 4,4 | 0,0 | 0,0 | 0,0 | 0,0 |
| | Micrococcales | 7,2 | 7,4 | 9,6 | 0,5 | 2,9 | 4,3 | 0,8 | 0,7 | 0,2 | 0,2 | 3,1 | 2,7 | 0,0 | 0,0 | 4,0 | 3,5 |
| | Bacteroidales | 0,3 | 0,3 | 13,6 | 11,8 | 6,5 | 7,1 | 26,1 | 27,7 | 14,8 | 16,1 | 0,7 | 0,6 | 0,1 | 0,0 | 3,5 | 2,4 |
| | Bacillales | 1,2 | 1,2 | 0,1 | 0,2 | 0,2 | 0,7 | 0,0 | 0,0 | 48,7 | 43,5 | 14,2 | 14,0 | 51,0 | 52,7 | 20,6 | 20,1 |
| | Lactobacillales | 0,5 | 0,6 | 40,9 | 44,6 | 0,7 | 2,5 | 0,3 | 0,2 | 1,5 | 1,6 | 21,9 | 26,4 | 0,0 | 0,0 | 0,1 | 0,1 |
| | Clostridiales | 0,3 | 0,3 | 1,2 | 1,4 | 18,5 | 11,2 | 0,4 | 0,2 | 5,7 | 5,9 | 5,4 | 5,4 | 0,1 | 0,1 | 1,5 | 1,0 |
| | Thermoanaerobacterales | 0,6 | 0,0 | 0,0 | 0,0 | 0,0 | 0,0 | 0,0 | 0,0 | 18,1 | 15,1 | 1,8 | 1,1 | 0,0 | 0,7 | 0,9 | 0,4 |
| | Betaproteobacteriales | 3,1 | 2,9 | 6,5 | 0,5 | 0,3 | 1,0 | 0,6 | 0,7 | 2,2 | 2,1 | 1,6 | 1,6 | 17,9 | 17,1 | 8,0 | 6,7 |
| | Xanthomonadales | 0,0 | 0,1 | 0,0 | 0,1 | 0,2 | 0,7 | 0,0 | 0,0 | 1,7 | 1,4 | 0,5 | 0,6 | 10,7 | 10,8 | 11,7 | 11,8 |
| | Total prokaryotes cells/ml | 4E+09 | 6E+09 | 3E+10 | 3E+10 | 5E+10 | 3E+10 | 2E+10 | 2E+10 | 2E+10 | 2E+10 | 3E+10 | 3E+09 | 5E+09 | 6E+09 | 8E+09 | 1E+10 |
| cells/ml (phylum) | Actinobacteria | 1E+09 | 1E+09 | 2E+09 | 1E+09 | 3E+09 | 1E+09 | 2E+08 | 3E+08 | 6E+07 | 7E+07 | 6E+08 | 7E+08 | 5E+05 | 5E+05 | 3E+08 | 4E+08 |
| | Bacteroidetes | 3E+09 | 4E+09 | 6E+09 | 6E+09 | 2E+10 | 5E+09 | 1E+10 | 1E+10 | 3E+09 | 5E+09 | 5E+09 | 4E+09 | 5E+07 | 3E+07 | 3E+09 | 5E+09 |
| | Firmicutes | 3E+08 | 3E+08 | 6E+09 | 7E+09 | 1E+10 | 2E+09 | 3E+08 | 8E+07 | 1E+10 | 2E+10 | 5E+09 | 4E+09 | 2E+09 | 4E+09 | 1E+09 | 4E+09 |
| cells/ml (order) | Corynebacteriales | 6E+08 | 1E+09 | 2E+09 | 1E+09 | 2E+09 | 2E+08 | 1E+08 | 2E+08 | 1E+07 | 2E+07 | 5E+08 | 4E+08 | 9E+04 | 0E+00 | 0E+00 | 4E+05 |
| | Micrococcales | 1E+08 | 4E+08 | 3E+07 | 2E+07 | 1E+09 | 6E+08 | 1E+08 | 1E+08 | 4E+07 | 4E+07 | 3E+08 | 3E+08 | 4E+05 | 5E+05 | 3E+05 | 4E+05 |
| | Bacteroidales | 1E+07 | 2E+07 | 2E+09 | 2E+09 | 1E+09 | 3E+08 | 5E+09 | 6E+09 | 3E+09 | 3E+09 | 5E+07 | 5E+07 | 5E+06 | 2E+06 | 3E+08 | 3E+08 |
| | Bacillales | 5E+07 | 7E+07 | 5E+06 | 1E+07 | 3E+07 | 3E+07 | 5E+08 | 6E+08 | 9E+09 | 5E+09 | 2E+09 | 1E+09 | 2E+09 | 4E+09 | 2E+09 | 3E+09 |
| | Lactobacillales | 2E+07 | 4E+07 | 5E+09 | 6E+09 | 3E+08 | 3E+08 | 4E+07 | 4E+07 | 3E+08 | 4E+08 | 2E+09 | 2E+09 | 2E+06 | 4E+06 | 7E+05 | 7E+05 |
| | Clostridiales | 1E+07 | 2E+07 | 2E+08 | 2E+08 | 9E+09 | 1E+09 | 5E+07 | 3E+07 | 1E+09 | 1E+09 | 6E+08 | 5E+08 | 5E+05 | 3E+05 | 1E+06 | 1E+06 |
| | Thermoanaerobacterales | 3E+05 | 6E+05 | 3E+05 | 2E+06 | 6E+00 | 1E+05 | 6E+00 | 8E+04 | 2E+09 | 3E+09 | 2E+08 | 1E+08 | 4E+07 | 5E+07 | 5E+07 | 5E+07 |
| | Betaproteobacteriales | 1E+08 | 2E+08 | 6E+07 | 7E+07 | 1E+08 | 1E+08 | 3E+07 | 5E+08 | 4E+08 | 5E+08 | 2E+08 | 1E+08 | 6E+08 | 1E+09 | 7E+08 | 7E+08 |
| | Xanthomonadales | 1E+06 | 3E+06 | 3E+06 | 1E+07 | 1E+08 | 8E+07 | 1E+06 | 2E+06 | 3E+08 | 3E+08 | 5E+07 | 5E+07 | 5E+08 | 9E+08 | 1E+09 | 1E+09 |

activity in an aqueous cellulose fiber suspension or in process water e.g. for a production method of a fibrous web containing cellulose fibers. Still, the present invention relates to a fibrous web, such as a paper, board, tissue or the like, an aqueous cellulose fiber suspension or process water for a production method of a fibrous web containing cellulose fibers, and a system for controlling cellulolytic activity in an aqueous fiber suspension or in process water.

18 Claims, 1 Drawing Sheet

(51) Int. Cl.

| | |
|---|---|
| ***D21C 7/12*** | (2006.01) |
| ***D21H 11/14*** | (2006.01) |
| ***D21H 17/00*** | (2006.01) |
| ***D21H 17/11*** | (2006.01) |
| ***D21H 17/67*** | (2006.01) |
| ***D21H 21/36*** | (2006.01) |

(52) U.S. Cl.
CPC ..... *D21H 17/11* (2013.01); *D21H 17/67* (2013.01); *D21H 17/74* (2013.01); *D21H 21/36* (2013.01)

(58) Field of Classification Search
CPC .... D21H 17/7464; D21H 23/78; D21H 17/74; Y02W 30/64
See application file for complete search history.

(56) References Cited

U.S. PATENT DOCUMENTS

| | | | | |
|---|---|---|---|---|
| 2008/0196853 | A1 | 8/2008 | Rice | |
| 2013/0186584 | A1* | 7/2013 | Krapsch ..... | D21H 17/28 162/161 |
| 2013/0319627 | A1 | 12/2013 | Van Haute | |
| 2014/0242191 | A1* | 8/2014 | Kolari ..... | A01N 65/00 424/641 |
| 2016/0032329 | A1 | 2/2016 | Leonetti et al. | |
| 2016/0177039 | A1 | 6/2016 | Xiao et al. | |
| 2020/0095730 | A1 | 3/2020 | Ekman et al. | |
| 2020/0299903 | A1 | 9/2020 | Kolari et al. | |

FOREIGN PATENT DOCUMENTS

| | | | |
|---|---|---|---|
| EP | 3450623 | A1 | 3/2019 |
| EP | 3450626 | A1 | 3/2019 |
| WO | 2004042082 | A1 | 5/2004 |
| WO | 20110092378 | A1 | 8/2011 |
| WO | 20120025228 | A1 | 3/2012 |
| WO | 2013026578 | A1 | 2/2013 |
| WO | 2015130442 | A1 | 9/2015 |
| WO | 2016135387 | A1 | 9/2016 |
| WO | 2017032927 | A1 | 3/2017 |
| WO | 2018234635 | A1 | 12/2018 |
| WO | 2019092317 | A1 | 5/2019 |

OTHER PUBLICATIONS

Collins et al.: "*Corynebacterium testudinoris* sp. nov., from a tortoise, and *Corynebacterium felinum* sp. nov., from a Scottish wild cat", International Journal of Systematic and Evolutionary Microbiology (2001), 51, pp. 1349-1352.

Yoo et al.: "*Sphingobacterium composti* sp. nov., isolated from cotton-waste composts", International Journal of Systematic and Evolutionary Microbiology (2007), 57, pp. 1590-1593.

Suihko et al.: "A study of the microflora of some recycled fibre pulps, boards and kitchen rolls", Journal of Applied Microbiology 1997, 83, pp. 199-207.

Search report from the State Intellectual Property Office of the People's Republic of China regarding corresponding application 2021800295311, mailed on Jun. 21, 2023 2p.

International Search Report and Written Opinion in Application No. PCT/FI2021/050292, mailed Jul. 26, 2021, 16 pages.

Search Report in Finnish Application No. 20205394, mailed Nov. 19, 2020, 2 pages.

Flint, H., et al. "Microbial degradation of complex carbohydrates in the gut," Gut Microbes, Jul. 1, 2012. 3(4): 289-306.

Reddy, et al. "Cellulolytic Activity of Fungal Cultures". Journal of Scientific & Industrial Research, 1998. vol. 57, pp. 617-620.

Lopez-Mondejar, R. et al. "Cellulose and hemicellulose decomposition by forest soil bacteria proceeds by the action of structurally variable enzymatic systems". Scientific reports, 2016. vol. 6, article No. 25279.

Koeck, D., et al. "Genomics of cellulolytic bacteria". Current Opinion in Biotechnology, 2014. 29:171-183.

Search report issued in corresponding CN application No. 2021800295311, issued Dec. 26, 2023.

Shen Yiding: "School and Chemical Lightning Auxiliaries of Advanced Chemical School", 1st Edition, Jul. 31, 2004, pp. 92-93.

Search Report in Chilean Application No. 202202867 and English translation thereof, mailed Dec. 11, 2024, 8 pages.

Office Action issued in the Korean Application 10-2022-7040249 on Nov. 24, 2025.

* cited by examiner

| | | Mill 1 | | Mill 2 | | Mill 3 | | Mill 4 | | Mill 5 | | Mill 6 | | Mill 7 | | Mill 8 | |
|---|---|---|---|---|---|---|---|---|---|---|---|---|---|---|---|---|---|
| | | WW | RCF | WW | RCF | WW | RCF | WW | RCF | WW | RCF | WW | RCF | WW | RCF | WW | RCF |
| % phylum | Actinobacteria | 22,1 | 24,0 | 12,1 | 9,0 | 7,0 | 10,6 | 1,8 | 1,6 | 0,3 | 0,3 | 7,7 | 7,2 | 0,0 | 0,0 | 4,0 | 3,5 |
| | Bacteroidetes | 63,6 | 63,0 | 42,8 | 41,5 | 44,3 | 44,8 | 75,9 | 74,3 | 19,7 | 21,5 | 42,3 | 39,2 | 1,0 | 0,8 | 36,8 | 41,0 |
| | Firmicutes | 2,2 | 2,2 | 43,1 | 47,3 | 21,5 | 18,7 | 0,7 | 0,5 | 75,5 | 74,0 | 44,5 | 47,7 | 52,9 | 54,5 | 31,3 | 31,8 |
| % order | Corynebacteriales | 14,7 | 16,4 | 11,5 | 8,5 | 4,0 | 5,5 | 0,9 | 0,9 | 0,1 | 0,1 | 4,6 | 4,4 | 0,0 | 0,0 | 0,0 | 0,0 |
| | Micrococcales | 7,2 | 7,4 | 0,6 | 0,5 | 2,9 | 4,9 | 0,8 | 0,7 | 0,2 | 0,2 | 3,1 | 2,7 | 0,0 | 0,0 | 4,0 | 3,5 |
| | Bacteroidales | 0,3 | 0,3 | 11,8 | 11,8 | 6,5 | 7,1 | 35,1 | 37,7 | 14,8 | 16,1 | 0,7 | 0,6 | 0,1 | 0,0 | 3,5 | 2,4 |
| | Bacillales | 1,2 | 1,2 | 0,1 | 0,2 | 0,2 | 0,7 | 0,0 | 0,0 | 49,7 | 43,9 | 14,3 | 14,0 | 51,8 | 52,7 | 28,6 | 30,1 |
| | Lactobacillales | 0,5 | 0,6 | 40,9 | 44,6 | 0,7 | 2,9 | 0,3 | 0,2 | 1,5 | 1,0 | 21,8 | 26,4 | 0,0 | 0,0 | 0,1 | 0,1 |
| | Clostridiales | 0,3 | 0,3 | 1,2 | 1,4 | 18,5 | 11,2 | 0,4 | 0,2 | 5,7 | 5,9 | 5,4 | 5,4 | 0,1 | 0,1 | 1,5 | 1,0 |
| | Thermoanaerobacterales | 0,0 | 0,0 | 0,0 | 0,0 | 0,0 | 0,0 | 0,0 | 0,0 | 13,1 | 15,1 | 1,8 | 1,1 | 0,8 | 0,7 | 0,9 | 0,4 |
| | Betaproteobacteriales | 3,2 | 2,9 | 0,5 | 0,5 | 0,3 | 1,0 | 0,6 | 0,7 | 2,2 | 2,1 | 1,6 | 1,6 | 17,9 | 17,1 | 8,0 | 6,7 |
| | Xanthomonadales | 0,0 | 0,1 | 0,0 | 0,1 | 0,2 | 0,7 | 0,0 | 0,0 | 1,7 | 1,4 | 0,5 | 0,6 | 10,7 | 10,8 | 12,7 | 11,3 |
| | Total prokaryotes cells/ml | 4E+09 | 6E+09 | 1E+10 | 1E+10 | 5E+10 | 1E+10 | 1E+10 | 2E+10 | 2E+10 | 2E+10 | 1E+10 | 9E+09 | 5E+09 | 8E+09 | 8E+09 | 1E+10 |
| cells/ml (phylum) | Actinobacteria | 1E+09 | 1E+09 | 2E+09 | 1E+09 | 3E+09 | 1E+09 | 2E+08 | 3E+08 | 6E+07 | 7E+07 | 8E+08 | 7E+08 | 5E+05 | 5E+05 | 3E+08 | 4E+08 |
| | Bacteroidetes | 3E+09 | 4E+09 | 6E+09 | 6E+09 | 2E+10 | 5E+09 | 1E+10 | 1E+10 | 3E+09 | 3E+09 | 5E+09 | 4E+09 | 5E+07 | 6E+07 | 3E+09 | 5E+09 |
| | Firmicutes | 1E+08 | 1E+08 | 6E+09 | 7E+09 | 1E+10 | 2E+09 | 1E+08 | 8E+07 | 1E+10 | 2E+10 | 5E+09 | 4E+09 | 2E+09 | 4E+09 | 3E+09 | 4E+09 |
| cells/ml (order) | Corynebacteriales | 6E+08 | 1E+09 | 2E+09 | 1E+09 | 2E+09 | 7E+08 | 1E+08 | 2E+08 | 1E+07 | 2E+07 | 5E+08 | 4E+08 | 9E+04 | 0E+00 | 0E+00 | 4E+05 |
| | Micrococcales | 3E+08 | 4E+08 | 8E+07 | 7E+07 | 1E+09 | 6E+08 | 1E+08 | 1E+08 | 4E+07 | 4E+07 | 3E+08 | 3E+08 | 4E+05 | 5E+05 | 3E+08 | 4E+08 |
| | Bacteroidales | 1E+07 | 2E+07 | 2E+09 | 2E+09 | 3E+09 | 9E+08 | 5E+09 | 6E+09 | 3E+09 | 3E+09 | 8E+07 | 5E+07 | 5E+06 | 2E+06 | 3E+08 | 3E+08 |
| | Bacillales | 3E+07 | 7E+07 | 9E+08 | 3E+07 | 8E+07 | 8E+07 | 3E+06 | 6E+06 | 9E+09 | 9E+09 | 2E+09 | 1E+09 | 2E+09 | 4E+09 | 2E+09 | 3E+09 |
| | Lactobacillales | 2E+07 | 4E+07 | 5E+09 | 6E+09 | 4E+08 | 3E+08 | 4E+07 | 4E+07 | 1E+08 | 4E+08 | 2E+09 | 2E+09 | 2E+06 | 4E+06 | 7E+06 | 7E+06 |
| | Clostridiales | 1E+07 | 2E+07 | 2E+08 | 2E+08 | 9E+09 | 1E+09 | 5E+07 | 3E+07 | 1E+09 | 1E+09 | 6E+08 | 5E+08 | 5E+06 | 6E+06 | 1E+08 | 1E+08 |
| | Thermoanaerobacterales | 3E+05 | 6E+05 | 3E+05 | 2E+06 | 0E+00 | 1E+05 | 0E+00 | 8E+04 | 2E+09 | 3E+09 | 2E+08 | 1E+08 | 4E+07 | 5E+07 | 8E+07 | 5E+07 |
| | Betaproteobacteriales | 1E+08 | 2E+08 | 6E+07 | 7E+07 | 1E+08 | 1E+08 | 8E+07 | 1E+08 | 4E+08 | 5E+08 | 2E+08 | 1E+08 | 8E+08 | 1E+09 | 7E+08 | 7E+08 |
| | Xanthomonadales | 2E+06 | 3E+06 | 3E+06 | 1E+07 | 1E+08 | 8E+07 | 1E+06 | 2E+06 | 3E+08 | 3E+08 | 5E+07 | 5E+07 | 5E+08 | 9E+08 | 1E+09 | 1E+09 |

METHOD OF CONTROLLING ENZYMATIC ACTIVITIES AND TOOLS RELATED THERETO

FIELD OF THE INVENTION

The present invention relates to the fields of fibers and uses thereof such as for producing fiber webs, such as paper, board or tissue. Specifically, the invention relates to a method of monitoring and controlling cellulolytic activity in an aqueous cellulose fiber suspension or process water for a production method of a fibrous web comprising recycled cellulose fibers. Also, the present invention relates to a method of manufacturing a fibrous web, such as a paper, board, tissue or the like, and use of a biocide for controlling cellulolytic activity in an aqueous cellulose fiber suspension comprising at least a share of recycled fibers or in process water e.g. for a production method of a fibrous web containing cellulose fibers. Still, the present invention relates to a fibrous web, such as a paper, board, tissue or the like, an aqueous cellulose fiber suspension or process water for a production method of a fibrous web comprising at least a share of recycled cellulose fibers, and a system for controlling cellulolytic activity in an aqueous at least partially recycled fiber suspension or in process water.

BACKGROUND OF THE INVENTION

In paper or board mills there can be problems with high microbial growth and poor process conditions. For example, acid production of microbes causes smells in the produced paper or board, and furthermore high conductivity in paper or board making process disturbs performance of papermaking chemicals and lowers machine productivity.

There are current practices for controlling micro-organisms e.g. in process waters or in fiber suspensions in the paper and board industry. In paper production methods growth of bacteria is commonly monitored and limited by using various means, e.g. by feeding of biocides. For example, WO2012/025228 A1 describes a method for manufacturing paper or board, wherein the cellulosic material containing the starch is treated with one or more biocides, and furthermore, a specific ionic polymer and an auxiliary ionic polymer are added to said cellulosic material. Said one or more biocides can prevent microbial degradation of at least a portion of the starch.

However, further specific applications are needed for controlling or measuring micro-organisms or specific properties thereof in order to obtain fibrous webs or process waters with desired properties.

BRIEF DESCRIPTION OF THE INVENTION

Defects of the prior art including but not limited to poor quality (e.g. smell, high conductivity and/or decreased strength) of paper, board or tissue products can be overcome by the present invention.

The objects of the present invention, namely a fibrous cellulose suspension or web (e.g. paper, board or tissue products) having specific properties of interest, and/or methods for producing cellulose fiber products with minimized or decreased strength loss enabling e.g. cost effectiveness as well as uniform quality of said cellulose fiber products, can be achieved by utilizing specific method steps comprising measuring or determining a cellulolytic activity of an aqueous cellulose fiber suspension or process water.

Indeed, it has now been surprisingly found that cellulolytic activity in an aqueous cellulose fiber suspension or process water can be so high that it results in unwanted loss of strength properties of the obtained fiber web products and said unwanted properties can be prevented by controlling the cellulolytic activity. After monitoring a cellulolytic activity in an aqueous cellulose fiber suspension or process water, said cellulolytic activity can be controlled e.g. by use of biocides. Cellulose fibers can be protected from bacterial cellulolytic degradation by use of one or more biocides, and thus the present invention enables improving the quality of fiber web end products.

The present invention makes it possible to determine and/or reduce a cellulolytic activity in one or more steps when producing a fiber web and furthermore, a cellulolytic activity can be reduced in a specific way or to a very specific level when needed. Thus, the present invention provides simple and cost-effective industrial scale methods and tools for monitoring and controlling paper or board production. Furthermore, by control methods the amount of used biocidal compositions for treating cellulose-containing suspensions can be optimized and thus, an excess use of biocides can be avoided.

In the prior art, activities of cellulose degrading microorganisms or enzymes have not been monitored or controlled in paper or board production conditions or for improving the quality of end products. An object of the present invention is thus to provide a tool and method for effective and specific monitoring of cellulolytic activity during a paper or board production method.

The present invention relates to a method of monitoring and controlling cellulolytic activity in an aqueous cellulose fiber suspension or process water for a production method of a fibrous web containing cellulose fibers, wherein the method comprises

- determining or estimating cellulolytic activity in an aqueous cellulose fiber suspension comprising recycled cellulose fibers or process water for a production method of a fibrous web containing recycled cellulose fibers, and
- controlling cellulolytic activity optionally by treating the aqueous cellulose fiber suspension or the process water with one or more biocides one or more times or optionally treating the aqueous cellulose fiber suspension or the process water with one or more biocides one or more times if the determined cellulolytic activity is above a pre-determined value.

Also, the present invention relates to a method of manufacturing a fibrous web, such as a paper, board, tissue or the like, wherein the method comprises

- forming an aqueous fiber suspension comprising recycled cellulosic fibers from one or more raw material flows and/or process water,
- determining or estimating cellulolytic activity of the aqueous cellulose fiber suspension, raw material flow and/or process water,
- controlling cellulolytic activity optionally by treating the aqueous cellulose fiber suspension or process water with one or more biocides one or more times or treating the aqueous cellulose fiber suspension or process water with one or more biocides one or more times if the determined cellulolytic activity is above a pre-determined value,
- forming the aqueous cellulose fiber suspension into a fibrous web and drying the fibrous web.

Still, the present invention relates to use of a biocide for controlling cellulolytic activity in an aqueous cellulose fiber suspension or in process water for a production method of a fibrous web containing cellulose fibers.

Still furthermore, the present invention relates to a system for controlling cellulolytic activity in an aqueous fiber suspension or in process water for a production method of a fibrous web containing cellulose fibers, wherein the system comprises one or more biocides, and optionally tools and/or instructions for determining cellulase activity in an aqueous fiber suspension or in process water.

Still furthermore, the present invention relates to a fibrous web, such as a web paper, board, tissue or the like, wherein said fibrous web is obtained with a method of the present invention. More specifically, the present invention relates to a fibrous web, such as a paper, board, tissue or the like, wherein said fibrous web has increased strength, tensile strength, strain at break, tensile stiffness, tensile energy absorption, breaking length, tear strength, and/or compressive strength (e.g. measured by SCT Short-Span Compressive Test), and said fibrous web is obtained with a method of the present invention.

Still furthermore, the present invention relates to an aqueous cellulose fiber suspension or process water for a production method of a fibrous web containing cellulose fibers, wherein said fiber suspension or process water is obtained with a method of the present invention.

Other objects, details and advantages of the present invention will become apparent from the following drawings, detailed description and examples.

BRIEF DESCRIPTION OF THE DRAWINGS

FIG. 1 shows that total bacterial densities of RCF suspension and white water (WW) (determined from a set of RCF-utilizing board machines by means of qPCR and Illumina high-throughput sequencing of partial 16S rRNA gene) were up to $5*10^{10}$ cells/ml process sample. According to sequence classification, surprisingly many of the process bacteria (54-98%) belonged to bacterial phyla with known cellulolytic potential and to bacterial orders with known cellulolytic potential (27 89%).

DETAILED DESCRIPTION OF THE INVENTION

The present invention concerns protection of fibers. Fiber materials used for paper, board or tissue production comprise cellulose, a substrate of cellulase enzymes. Now the inventors of the present disclosure have surprisingly found such levels of cellulase activity in wet-end of a paper or board machine that can impact strength properties of the cellulose fiber web products, and have surprisingly found out that strength properties of cellulose fiber web products, also including recycled fibers, can be controlled through maintaining or amending (e.g. increasing or decreasing) cellulolytic activities of fiber suspensions comprising cellulose or process water during production methods of said fiber web products. A method of monitoring and controlling cellulolytic activity in an aqueous cellulose fiber suspension or process water for a production method of a fibrous web comprises determining cellulolytic activity in an aqueous cellulose fiber suspension or process water.

The aqueous cellulose fiber suspension or fibrous web is formed from or comprises cellulosic or lignocellulosic fibers, optional papermaking additives and water. Furthermore, the process water for a production method of a fibrous web can comprise cellulosic fibers. The cellulosic fibers may be virgin fibers obtained by any known pulping process and/or they may be recycled fibers and/or they may originate from broke. For example, the fiber stock may comprise cellulosic fibers obtained by mechanical pulping, chemical pulping, chemithermomechanical pulping or by repulping recycled or recovered fibers. The cellulosic fibers can be refined or unrefined, bleached or unbleached. The cellulosic fibers may be recycled unbleached or bleached kraft pulp fibers, hardwood semi-chemical pulp fibers, grass pulp fibers or any mixtures thereof. In one embodiment of the invention the aqueous cellulose fiber suspension comprises recycled fibers, the fibers of the aqueous cellulose fiber suspension are recycled fibers and/or the process water is for a production method of a fibrous web containing recycled cellulose fibers. In another embodiment the cellulose fiber suspension or fibrous web comprises fibers from broke or the fibers of the suspension are from broke.

Uncontrolled growth of microorganisms in papermaking process can disturb production. Machines that utilize bleached virgin fibers for making of white paper products, such as copy paper, are sensitive for runnability problems (paper defects or break of the paper web) caused by detaching pieces of slime. Those are formed on machine surfaces by biofilm-forming bacteria. The biofilm problem, and causative organisms such as *Meiothermus* and *Deinococcus*, have been actively studied in machines using virgin cellulose fibers. In contrary, prior to this research, very little was known about microbiology in machines using recycled fibers as raw material. For example, in machines that utilize recycled unbleached containerboard as raw material, it was known that process typically contains a lot of microorganisms and fermentation can cause unwanted drop of pH drop and increase of conductivity in the process water. However, causative organisms were unknown.

Use of recycled fibers in papermaking is desired due to an environmental aspect. This invention allows using higher share of recycled fiber raw material without compromising the properties (such as strength) of the end-product (e.g. paper, board or tissue products). In other words, this invention allows using even 100% recycled fiber out of the total fiber material used. Alternatively, this invention allows using 100% of recycled fiber, in a manner that a higher share of fibers is lower quality recycled fiber, e.g. unsorted OCC, mixed waste paper or mixed office waste paper. Alternatively, or in addition, this invention allows using a higher share of recycled fiber of the fiber material, in combination with virgin fiber material. The amount of recycled fiber may comprise at least 40%, at least 60%, at least 80%, at least 90% of the total fiber material, even up to 100% of fiber material.

The aqueous cellulose fiber suspension may be formed by combining two or more raw material flows (at least one material flow comprising cellulosic fibers from one or different sources) and/or fresh water and/or circulated process water. The aqueous fiber suspension may contain one or several known chemical additives used in pulp and paper making.

As used herein "a cellulolytic or cellulase activity" refers to a capability or potential capability of degrading or hydrolyzing cellulose by enzymes. The potential, presence, absence, amount or type of cellulolytic or cellulase activities e.g. in a sample, polypeptide or micro-organism can be detected or measured in the present invention. For example, degradation can be reducing the amount of cellulose by less than 1%, or about 1% or more, 5% or more, 10% or more, 20% or more, 30% or more, 40% or more, 50% or more, 60% or more, 70% or more, 80% or more, 90% or more. Detections or measurements suitable for the present invention can be either directly or indirectly revealing the cellulolytic activity. As used herein "indirect" detections or measurements include but are not limited to those revealing potential cellulolytic activity or potential cellulolytic microbes. For example, when specific microbes known to be cellulolytic or known to have genomic potential for enzymatic cellulose degradation are detected from a sample, the presence of a cellulolytic activity in said sample can be indirectly determined. In one embodiment specific microbes are known to be cellulolytic or known to be capable of (enzymatic) cellulose degradation by prior art publications, EC classification and/or Carbohydrate-Active enZYme families classification (http://www.cazy.org/).

Non-limiting examples of suitable methods for detecting or measuring cellulolytic or cellulase activity include commercial kits on market, enzymatic or protein assays, immunological detection methods (e.g., antibodies specific for said enzymes or polypeptides), nucleotide or PCR-based assays and sequencing (e.g. PCR, qPCR, RT-PCR, next generation sequencing, high throughput sequencing), and any combination thereof. For example, commercial enzyme substrates (such as fluorophore-labelled enzyme substrates) enable sensitive quantification of degrading or hydrolytic activity regardless of specific enzyme structures. Commercial fluorophore-labelled enzyme substrates can be used for example in testing of enzyme producing micro-organisms. A cellulolytic or cellulase activity can also be demonstrated by agar-based methods by exploiting the ability of carboxymethylcellulose (CMC) to form gel-like surfaces, which are sensitive to cellulolytic degradation. Also, a filter paper assay is known to a person skilled in the art (see e.g. Reddy et al. 1998, Journal of Scientific & Industrial Research, vol. 57, pages 617-620). For determining whether enzymes of one type or even several different types are acting on celluloses kinetic experiments can be utilized.

In one embodiment of the invention determining cellulolytic activity comprises determining cellulolytic or cellulase activity and/or cellulolytic microbes in the aqueous fiber suspension or process water. Cellulolytic activity can be evaluated for example by quantifying cellulolytic microbes or cellulases or the cellulase activity of e.g. a sample, micro-organism or polypeptide. In one embodiment the method comprises determining the potential, presence, absence, amount or type of cellulolytic or cellulase activity, cellulases and/or cellulolytic microbes. The term "cellulolytic enzyme" comprises cellulases but may comprise also e.g. hemicellulases.

Cellulases are polypeptides comprising a cellulase activity, i.e. they are capable of catalyzing the decomposition of cellulose polymer (cellulolysis, hydrolysis of cellulose). Cellulases belong to a group of hydrolases and can break down the cellulose molecule into monosaccharides such as beta-glucose, or shorter polysaccharides and oligosaccharides. Cellulose degradation can be the result of a synergic process between different kind of cellulases, e.g. at least an endoglucanase and/or exoglucanase. For example, bacterial endoglucanases degrade β-1,4-glucan linkages of cellulose amorphous zones, meanwhile exoglucanases cleave the remaining oligosaccharide chains, originating cellobiose. Several different kinds of cellulases are known, which differ structurally and mechanistically. "A cellulase" refers to not only fungal or bacterial but also to any other cellulase homologue from any micro-organism, organism or mammal. Also, all isozymes, isoforms and variants are included with the scope of a cellulase. It is well known that a deletion, addition or substitution of one or a few amino acids does not necessarily change the catalytic properties of an enzyme. Therefore, the invention also encompasses variants and fragments of cellulases having the enzyme activity of interest, namely a cellulose degrading or hydrolyzing activity. Some examples of a cellulase and a polynucleotide encoding said cellulase are identified in the articles of Flint et al., López-Mondéjar et al. and Koeck et al. (Flint H et al. 2012, Gut Microbes July 1; 3(4): 289-306; López-Mondéjar R et al. 2016, Scientific reports volume 6, article number: 25279; Koeck D et al. 2014, Current Opinion in Biotechnology, 29:171-183). For example, a cellulase can be classified as EC 3.2.1.X (e.g. EC 3.2.1.4, EC 3.2.1.91, EC 3.2.1.21). In one embodiment cellulases can be classified based on Carbohydrate-Active enZYme families, i.e. CAZY-families including cellulases (http://www.cazy.org/). For example, an enzyme or cellulase with characterized cellulolytic activity can belong to the family selected from the group consisting of GH1, GH3, GH5, GH6, GH8, GH9, GH12, GH45, GH48, GH51 and GH748.

In the present disclosure, the terms "polypeptide" and "protein" are used interchangeably to refer to polymers of amino acids of any length. As used herein "an enzyme" refers to a protein or polypeptide which is capable of accelerating or catalyzing chemical reactions.

As used herein "a polynucleotide" refers to any polynucleotide, such as single or double-stranded DNA (e.g. genomic DNA or cDNA) or RNA (e.g. mRNA, rRNA), optionally comprising a nucleic acid sequence encoding a polypeptide in question or a conservative sequence variant thereof. Conservative nucleotide sequence variants (i.e. nucleotide sequence modifications, which do not significantly alter biological properties of the encoded polypeptide) include variants arising from the degeneration of the genetic code and from silent mutations.

In the present disclosure, the terms "micro-organism" and "microbe" are used interchangeably. "A cellulolytic micro-organism" or "cellulolytic microbe" means a micro-organism or microbe capable of producing cellulolytic activity at least in certain phase of life cycle.

In one embodiment of the invention cellulolytic microbes are determined with a nucleic acid-based method. Determination of all potential cellulase genes or cellulase gene transcripts may be captured through nucleic acid or protein assays. Cellulolytic microbes can be measured by measuring known cellulolytic microbial taxa. RNA and/or DNA based methods are suitable nucleic acid methods for the present invention and include but are not limited to hybridization methods (e.g. southern or northern blotting, slot/dot blot, colony blot, fluorescence in situ hybridization, microarray), PCR methods (e.g. qPCR, RT-PCR, qRT-PCR, multiplex-PCR, digital PCR, colony PCR), and sequencing methods (e.g. basic cloning and Sanger sequencing methods, next generation sequencing, high-throughput sequencing).

Micro-organism cells are normally present in many aqueous environments of pulp mills as well as paper and board mills. For example, there can be more than 10 billion micro-organisms or bacteria in each ml of fiber suspension or process water (e.g. whitewater).

In one embodiment of the invention the cellulolytic activity determined in an aqueous cellulose fiber suspension or process water for a production method of a fibrous web containing cellulose fibers is microbial, fungal or bacterial cellulolytic activity. General detection of cellulose degraders, independent of the microbe name or the enzyme structure is possible via e.g. quantitative measurement of these hydrolytic enzymatic activities or potential of said activities in process samples. Any cellulolytic activities, cellulolytic micro-organisms or cellulases can be determined by the present invention. Non-limiting examples of cellulolytic microbe(s) include but are not limited to, or is(are) selected from the group consisting of bacterial phyla Actinobacteria, Bacteroidetes, Firmicutes, and/or orders Corynebacteriales, Micrococcales, Bacteroidales, Bacillales, Lactobacillales, Clostridiales, Thermoanaerobacterales, Betaproteobacteriales, Xanthomonadales, and/or any family or genus belonging to said phyla or orders, optionally according to taxonomy of Bergey's Manual of Systematic Bacteriology, $2^{nd}$ Ed., and Silva v. 132 taxonomy. Indeed, by the present invention it is possible to characterize cellulolytic microbes in general or specific cellulolytic microbes (e.g. a specific phyla, orders, family or genus) of systems for paper or board production, cellulose fiber suspensions and fiber webs.

In one embodiment of the invention cellulolytic activity of an aqueous cellulose fiber suspension or process water is determined and compared to a pre-determined cellulolytic activity value. In one embodiment the pre-determined cellulolytic activity value is more than 0.1, 0.2, 0.5 mU/ml or 1.0 mU/ml of the aqueous fiber suspension or process water, the pre-determined cellulolytic activity value is a cellulolytic microbe (cellulase producing microbe) level more than $1\times10^6$, $1\times10^7$, $1\times10^8$, or $1\times10^9$ microbes in ml of the aqueous fiber suspension or process water, and/or the pre-determined cellulolytic microbe level is more than 5%, 10%, 25%, 40%, 60% of the total microbes (total number of) in the aqueous fiber suspension or process water.

Cellulase activity expressed here as "mU/ml" may be obtained using Enzchek Cellulase substrate (Life Technologies, part of Thermo Fisher Scientific), using the manufacturer's instructions and measurement protocol where sodium acetate buffer is adjusted to pH 6.0 and the samples are diluted 1/10 to minimize inhibition and quenching by fibers.

No adjustment of the cellulolytic activity is necessary if the determined cellulolytic activity of the aqueous fiber suspension or process water is for example absent, low or below the pre-determined cellulolytic activity value. However, adjustments may be done if deemed advantageous or even necessary e.g. on basis of other parameters. Indeed, after determining the cellulolytic activity (the first determination) said activity can be controlled by either maintaining or adjusting (decreasing or increasing) with one or more biocides either one or more times, if needed.

The present invention concerns fiber web production methods, machines or parts thereof and includes but is not limited to all paper, tissue or board production systems as well as intermediate residence entities (such as storage towers, broke towers, fiber suspension towers) and process water containers. Aqueous cellulose fiber suspension is formed from a number of raw material flows, typically a plurality of raw material flows, such as water flow and various pulp flows comprising cellulosic fibers. Raw material flows are combined together and form the aqueous fiber suspension which is fed to the intermediate residence entity. The cellulolytic activity of a fiber, fiber suspension or process water can be determined in any step of producing fiber webs. In one embodiment the cellulolytic activity of the fiber suspension or process water is determined before an inlet of an intermediate residence entity, in the intermediate residence entity, and/or after an outlet of an intermediate residence entity. Therefore, the measured cellulolytic activity levels e.g. in an intermediate residence entity can be controlled or adjusted to a desired level for example in said intermediate residence entity and/or after an outlet of said intermediate residence entity. The intermediate residence entity may be any pulp, water or broke storage tower or tank or corresponding entity. In one embodiment the cellulolytic activity is determined before, in or after a pulp storage tower, a pulp storage tank, broke storage tower and/or broke storage tank, or from a sample obtained before, from or after a pulp storage tower, a pulp storage tank, broke storage tower and/or broke storage tank. According to one embodiment of the invention the method comprises a plurality of intermediate residence entities, such as pulp, water or broke storage towers or tanks or corresponding entities or any combination thereof, arranged in the series.

In the method of the present invention cellulolytic activity is determined e.g. in an aqueous fiber suspension for example in the intermediate residence entity or process water. In one embodiment the method of the present invention comprises determining cellulolytic activity of a sample obtained from the aqueous fiber suspension or process water. The sample to be determined can be from the intermediate residence entity.

The intermediate residence entity may have a delay time of at least one hour, preferably at least two hours, before the formation of the web. Delay time is here understood as an average residence time for the aqueous cellulose fiber suspension in the intermediate residence entity. The intermediate residence entity may have a delay time in the range of 1-48 h, 1-24 h, 1-12 h, typically 1-8 h, more typically 2-7 h. In one embodiment the aqueous cellulose fiber suspension to be determined is in or from an intermediate residence entity with a delay time of 1-48 hours, 1 24 hours, 1-12 hours, typically at least 1 hour or 2 hours, e.g. at least 3, 4, 5, 6, 7, 8, 9, 10, or 11 hours. Typically, the consistency of the aqueous cellulose fiber suspension in the intermediate residence entity is at least 2 g/I, typically in the range of 10-150 g/I.

After determining cellulolytic activity, especially cellulase activity, said cellulolytic activity can be maintained, increased or decreased with one or more biocides, if needed, to obtain a desired final cellulolytic activity (e.g. cellulase activity or microbe level). For example, one or more biocides can be used for maintaining the cellulolytic activity in a situation, wherein cellulolytic activity would increase without said biocide(s). On the other hand, just small amounts of one or more biocides can result in some increase of the cellulolytic activity. In one embodiment one or more biocides are used for decreasing the cellulolytic activity. And still, controlling of cellulolytic activity includes also an option not to use one or more biocides when they are not needed. Cellulolytic activity of the biocide treated fiber suspension or process water can be determined one or more times for confirming the desired obtained cellulolytic activity. One or more biocide treatment steps may be needed for obtaining the desired cellulolytic activity level. Indeed, the second, third or more and/or final cellulolytic activity levels can optionally be determined in order to evaluate the effect of the one or more biocide treatments or a need for further treatments. In one embodiment continuous monitoring by determining cellulolytic activity and optionally process control by dosing of biocides is utilized.

The determined (first, or optional second, third or more, or final) cellulolytic values of the aqueous fiber suspension or process water can be used for controlling the cellulolytic activity e.g. before an inlet of an intermediate residence entity, in the intermediate residence entity, and/or after an outlet of an intermediate residence entity (such as a pulp storage tower and/or broke storage tower), but e.g. before the aqueous fiber suspension exits the headbox or the like and is formed into a web.

Indeed, the inventors of the present disclosure have surprisingly found that cellulolytic activity, caused by microorganisms, can occur in the aqueous fiber-containing process at such intensity, that it can lead to fiber degradation detectable in the strength of the fiber web end product such as a paper or board, and said cellulolytic activity can be controlled with one or more biocides, if any control is needed. In one embodiment of the method the cellulolytic activity in an aqueous fiber suspension or process water is controlled for improving or maintaining the strength of fibers or the fibrous web. A significant reduction of paper strength can take place if cellulolytic activities are not controlled during manufacturing of paper products.

An adjustment of cellulolytic or cellulase activity may be done indirectly by subjecting the cellulolytic micro-organisms (microbes) to a biocide treatment to destroy, deter, render harmless, or exert a controlling effect on any harmful organism.

In one embodiment the cellulolytic activity is controlled or decreased by treating the aqueous cellulose fiber suspension or process water with one or more biocides one or more times if the determined cellulolytic activity is considered too high or having increasing tendency after two or more determinations. In a specific embodiment the cellulolytic activity is controlled by treating the aqueous cellulose fiber suspension or process water with a biocide one or more times if the determined cellulolytic activity is above a pre-determined value. At least one biocide capable of inhibiting cellulolytic activity can be applied to the aqueous cellulose fiber suspension, at least one raw material flows and/or process water. For example, one or more biocides (optionally with other chemicals or agents) can be added to the broke system, broke storage tower(s), broke storage tank(s), pulp, pulp storage tower(s), pulp storage tank(s), water entering the pulper or any storage tank(s), and/or pipe line before broke or pulp storage tanks. Indeed, the aqueous cellulose fiber suspension can be treated with one or more biocides e.g. in the broke system, broke storage tower(s), broke storage tank(s), pulp, pulp storage tower(s), and/or pulp storage tank(s). The process water can be treated with one or more biocides e.g. when entering the pulper or any storage tank(s) and/or in a pipe line before broke or pulp storage tanks.

In one embodiment the cellulolytic or cellulase activity or the level of cellulolytic microbes is altered with one or more biocides optionally together with a further agent or agents. For example, the number or level of cellulolytic microbes can be reduced, or cellulolytic microbes can be eliminated. Furthermore, or alternatively, the cellulolytic or cellulase activity of microbes can be inhibited either partly or totally, e.g. to a background level. If biocides are not used for inhibiting cellulolytic activities of microbes, said activities can remain or increase during a method of manufacturing fibrous webs.

In one embodiment, if the determined cellulolytic activity is high (e.g. above a predetermined value) or estimated to increase (e.g. above a pre-determined value) the cellulolytic activity can be controlled to a specific level (e.g. below said pre-determined value), e.g. to a cellulolytic or cellulase activity level 0-0.1 mU/ml, 0-0.2 mU/ml, 0-0.3 mU/ml, 0-0.4 mU/ml, 0-0.5 mU/ml or 0-1.0 mU/ml of the aqueous cellulose fiber suspension or process water, to a cellulolytic microbe level $0\text{-}1\times10^6$, $0\text{-}1\times10^7$, $0\text{-}1\times10^8$, or $0\text{-}1\times10^9$ microbes in ml of the aqueous cellulose fiber suspension or process water, and/or to a cellulolytic microbe level 0-5%, 0 6%, 0-7%, 0-8%, 0-9%, 0-10%, 0-15%, 0-20% or 0-25% of the total microbes in the aqueous cellulose fiber suspension or process water (microbes in ml of the aqueous cellulose fiber suspension or process water).

In one embodiment of the invention after determining the cellulolytic activity said cellulolytic activity is controlled by decreasing a cellulolytic or cellulase activity at least 1%, 2%, 3%, 4%, 5%, 6%, 7%, 8%, 9%, 10%, 15%, 20%, 25%, 30%, 35%, 40%, 45%, 50%, 55%, 60%, 65%, 70%, 75%, 80%, 85%, 90%, 95% or 100% (mU/ml of the aqueous cellulose fiber suspension or process water), and/or a cellulolytic microbe level is controlled by decreasing at least 5%, 10%, 20%, 30%, 40%, 50%, 60%, 70%, 80%, 90% or 100%, or even more (microbes in ml of the aqueous cellulose fiber suspension or process water).

In one embodiment the controlled, decreased or predetermined cellulolytic activity ranges or levels provide optimal conditions for protecting fibers when producing fiber webs comprising cellulose. One or more biocide treatment steps may be needed for obtaining a desired cellulolytic activity level.

In one embodiment the biocide used in the method or system of the present invention for controlling cellulolytic activities is or comprises an oxidizing biocide and/or a non-oxidizing biocide. In one embodiment the biocide is a non-oxidizing biocide and selected from the group consisting of: 2,2-Dibromo-3-nitrilopropionamide (DBNPA); 2-Bromo-2-nitropropane-1,3-diol (Bronopol); 2-Bromo-2-nitro-propan-1-ol (BNP); 2,2-Dibromo-2-cyano-N-(3-hydroxypropyl)acetamide; 2,2-Dibromomalonamide; 1,2-Dibromo-2,4-dicyanobutane (DCB); Bis(trichloromethyl) sulfone; 2-Bromo-2-nitrostyrene (BNS); Didecyldimethylammonium chlorine (DDAC); N-Alkyl-N-benzyl-N,N-dimethylammonium chloride (ADBAC) and other quaternary ammonium compounds; 3-Iodopropynyl-N-butylcarbamate (IPBC); Methyl and Dimethyl-thiocarbamates and their salts; 5-Chloro-2-methyl-4-isothiazolin-3-one (CMIT); 2-Methyl-4-isothiazolin-3-one (MIT) and their mixture; 2-n-Octyl-4-isothiazolin-3-one (OIT); 4,5-Dichloro-2-(n-octyl)-3(2H)-isothiazolone (DCOIT); 4,5-Dichloro-1,2-dithiol-3-one; 1,2-Benzisothiazolin-3-one (BIT); 2-(Thiocyanomethylthio)benzthiazole (TCMBT); 2-Methyl-1,2-benzisothiazolin-3(2H)-one (MBIT); Tetrakis hydroxymethyl phosphonium sulfate (THPS); Tetrahydro-3,5-dimethyl-2H-1,3,5-thiadiazine-2-thione (Dazomet); Methylene bisthiocyanate (MBT); Ortho-phenylphenol (OPP) and its salts; Glutaraldehyde; Ortho-phthaldehyde (OPA); Guanidines and biguanidines; N-dodecylamine or n-dodecylguanidine; dodecylamine salt or dodecylguanidine salt, such as dodecylguanidine hydrochloride; Bis-(3-aminopropyl)dodecylamine; Pyrithiones, such as Zinc pyrithione; Triazines such as Hexahydro-1,3,5-trimethyl-1,3,5-triazine; 3-[(4-Methylphenyl)sulfonyl]-2-propenenitrile; 3-Phenylsulphonyl-2-propenenitrile; 3-[(4-trifluormethylphenyl)sulphonyl]-2-propenenitrile; 3-[(2,4,6-trimethylphenyl)sulphonyl]-2-propenenitrile; 3-(4-methoxyphenyl) sulphonyl-2-propenenitrile; 3-[(4-methylphenyl)sulphonyl] prop-2-enamide; and any of their isomers; and any combination thereof; and/or the biocide is an oxidizing biocide and selected from the group consisting of: chlorine; alkali and alkaline earth hypochlorite salts; hypochlorous acid; bromine; alkali and alkaline earth hypobromite salts; hypobromous acid; chlorine dioxide; ozone; hydrogen peroxide; peroxy compounds, such as performic acid, peracetic acid, percarbonate or persulfate; halogenated hydantoins, such as monohalodimethylhydantoins; dihalodimethylhydantoins; perhalogenated hydantoins; monochloramine; monobromamine; dihaloamines; trihaloamines; urea reacted with an oxidant, the oxidant being e.g. alkali and alkaline earth hypochlorite salts or alkali and alkaline earth hypobromite salts; ammonium salts, e.g. ammonium bromide, ammonium sulfate or ammonium carbamate, reacted with an oxidant, the oxidant being preferably alkali and alkaline earth hypochlorite salts or alkali and alkaline earth hypobromite salts; and any combination thereof.

In one embodiment the biocide used in the method or system of the present invention for controlling cellulolytic activities is or comprises an oxidizing biocide and/or a non-oxidizing biocide. In one embodiment the biocide is a non-oxidizing biocide and selected from the group consisting of: 2,2-Dibromo-3-nitrilopropionamide (DBNPA); 2-Bromo-2-nitropropane-1,3-diol (Bronopol); Didecyl-dimethylammonium chlorine (DDAC); N-Alkyl-N-benzyl-N,N-dimethylammonium chloride (ADBAC); 5-Chloro-2-methyl-4-isothiazolin-3-one (CMIT); 2-Methyl-4-isothiazolin-3-one (MIT) and their mixture; 2-n-Octyl-4-isothiazolin-3-one (OIT); 4,5-Dichloro-2-(n-octyl)-3(2H)-isothiazolone (DCOIT); Glutaraldehyde; dodecylamine salt or dodecylguanidine salt, such as dodecylguanidine hydrochloride; 3-[(4-Methylphenyl)sulfonyl]-2-propenenitrile and any of its isomers; and any combination thereof; and/or the biocide is an oxidizing biocide and selected from the group consisting of: performic acid, monochloramine, ammonium salts reacted with hypochlorite, halogenated hydantoins, such as monochlorodimethylhydantoin or monobromodimethyl hydantoin; and any combination thereof.

In one embodiment the biocide used in the method or system of the present invention for controlling cellulolytic activities is or comprises an oxidizing biocide and a non-oxidizing biocide. In one embodiment the non-oxidizing biocide comprises one or more biocides selected from the group consisting of: 2,2-Dibromo-3-nitrilopropionamide (DBNPA); 2-Bromo-2-nitropropane-1,3-diol (Bronopol); 5-Chloro-2-methyl-4-isothiazolin-3-one (CMIT), 2-Methyl-4-isothiazolin-3-one (MIT) and their mixture; Glutaraldehyde; dodecylguanidine hydrochloride; 3-[(4-Methylphenyl)sulfonyl]-2-propenenitrile and any of its isomers; and any combination thereof; and the oxidizing biocide is selected from the group consisting of:

performic acid, monochloramine, ammonium salts reacted with hypochlorite, monochlorodimethylhydantoin or monobromodimethyl hydantoin; and any combination thereof.

In an embodiment the biocide used in the method or system of the present invention for controlling cellulolytic activities comprises one oxidizing biocide selected from a list consisting of performic acid, monochloramines, ammonium salts reacted with hypochlorite, monochlorodimethylhydantoin or monobromodimethyl hydantoin and two or more non-oxidizing biocides selected from a list consisting of 2,2-Dibromo-3-nitrilopropionamide (DBNPA); 2-Bromo-2-nitropropane-1,3-diol (Bronopol); 5-Chloro-2-methyl-4-isothiazolin-3-one (CMIT), 2-Methyl-4-isothiazolin-3-one (MIT) and their mixture; Glutaraldehyde; and dodecylguanidine hydrochloride; 3-[(4-Methylphenyl)sulfonyl]-2-propenenitrile and any of its isomers; and any combination thereof.

The amounts of biocides to be used depend e.g. on the type of fiber suspension or process water used, cellulolytic activity of said suspension or process water, delay times in residence entities, duration of methods for manufacturing fibrous webs, degree of fresh water usage, the type of the biocide(s) and/or the number of biocide treatments. In one embodiment the fiber suspension or process water is treated with one or more biocides. The added biocide concentration can be e.g. about 0.1-1000 ppm, 1-800 ppm, 3-500 ppm, 5-250 ppm, e.g. about 10, 50, 100, 150 or 200 ppm, based on the active compound content of the biocide. As used herein ppm means a weight of an active compound per volume. In one embodiment the added biocide concentration can be e.g. about 0.1-1000 mg/l, 1-800 mg/l, 3-500 mg/l, 5-250 mg/l, e.g. about 10, 50, 100, 150 or 200 mg/l, based on the active ingredient of the biocide.

In one embodiment the aqueous cellulose fiber suspension or process water is treated with a combination of one or more biocides and (added) zinc ions (e.g. one or more zinc salts). The biocide(s) and zinc ions can be added simultaneously (e.g. as a pre-mix) or consecutively to the cellulose fiber suspension or process water; the biocide(s) can be added prior to the addition of the zinc ions; and/or the zinc ions can be added prior to the addition of the biocide(s). Also, it is possible to add the biocide(s) continuously and zinc ions intermittently, or zinc ions continuously and the biocide(s) intermittently. If the biocide and zinc ions are added consecutively, the time between additions of the biocide(s) and zinc ions can be e.g. 1 second-180 minutes, 1-60 minutes, 5-30 minutes or 10-20 minutes.

In one embodiment the zinc ions are derived from an inorganic or organic zinc salt; or the zinc ion source is selected from a group consisting of: $ZnBr_2$, $ZnCl_2$, $ZnF_2$, $ZnI_2$, ZnO, $Zn(OH)_2$, ZnS, ZnSe, ZnTe, $Zn_3N_2$, $Zn_3P_2$, $Zn_3As_2$, $Zn_3Sb_2$, $ZnO_2$, $ZnH_2$, $ZnC_2$, $ZnCO_3$, $Zn(NO_3)_2$, $Zn(ClO_3)_2$, $ZnSO_4$, $Zn_3(PO_4)_2$, $ZnMoO_4$, $ZnCrO_4$, $Zn(AsO_2)_2$, $Zn(AsO_4)_2$, $Zn((O_2CCH_3)_2)$, zinc metal, and a combination thereof.

The amounts of zinc ions to be used depend e.g. on the fiber suspension or process water used, the type of the biocide and/or the type of zinc ions. In one embodiment the fiber suspension or process water is treated with one or more sources of zinc ions. The added zinc ion concentration can be e.g. about 0.1-500 ppm, 1-400 ppm, 3-250 ppm, 5-100 ppm, e.g. about 10, 20, 30, 40, 50, 60, 70, 80 or 90 ppm zinc ions in the aqueous cellulose fiber suspension or process water. In one embodiment the added zinc ion concentration can be e.g. about 0.1-500 mg/l, 1-400 mg/l, 3-250 mg/l, 5-100 mg/l, e.g. about 10, 20, 30, 40, 50, 60, 70, 80 or 90 mg/l zinc ions in the aqueous cellulose fiber suspension or process water to be treated.

In one embodiment the zinc ions and biocide(s) are used in a ratio of about 1:1 to 100:1, typically 1:10 to 100:1, such as 1:20 to 20:1, 1:10 to 10:1, 1:5 to 20:1, 1:5 to 5:1, 1:2 to 5:1, or 1:2 to 2:1.

The present invention also concerns a method of protecting cellulose and/or preventing or reducing the cellulolytic activity in an aqueous fiber suspension comprising cellulosic fibers from one or more raw material flows and/or process water.

The present invention also concerns a method for manufacturing a fibrous web, such as web of paper, board, tissue or the like, comprising forming an aqueous fiber suspension comprising recycled cellulosic fibers from one or more raw material flows and/or process water, determining cellulolytic activity of the aqueous cellulose fiber suspension, raw material flow and/or process water, controlling cellulolytic activity optionally by treating the aqueous cellulose fiber suspension or process water with one or more biocides one or more times or optionally treating the aqueous cellulose fiber suspension or process water with one or more biocides one or more times if the determined cellulolytic activity is above a pre-determined value, forming the aqueous cellulose fiber suspension into a fibrous web and drying the fibrous web.

The aqueous fiber suspension can be formed into a fibrous web and dried in any suitable manner (e.g. by heating and/or removing liquid or water by pressing). The temperature during heating can be e.g. at least 100° C., typically at least 110° C., for at least 0.3 min, e.g. at least 0.5 min, sometimes at least 1 min. The temperature during water removal by pressing may vary and can be e.g. at least RT, typically at least 20° C., 25° C., 40° C., 60° C., 80° C. or at least 100° C.

The present invention further concerns use of a biocide for controlling cellulolytic activity in an aqueous fiber suspension or in process water for a production method of a fibrous web. For example, the biocide(s) can be applied to a broke system, broke storage tower(s), broke storage tank(s), pulp, pulp storage tower(s), pulp storage tank(s), water entering the pulper or any storage tank(s), and/or pipe line before broke or pulp storage tanks.

For example, there can be a biocide treatment point in process where the biocide dosing pump is automated, i.e., the batch dosing frequency is auto-adjusting based on process parameters such as filling degree of a storage tower (indicator for storage time) and pH of process water. Measurement results about cellulase activity and/or cellulolytic microbes in the process may be utilized as multipliers in that kind of an automation logic, i.e. lowering or increasing the dosing frequency based on the result values. In case of working with a non-automated dosing pump, the dosing frequency can be manually adjusted based on the measurement result value.

The present invention further concerns a fibrous web, such as a paper, board, tissue or the like, wherein the manufacturing process of said fibrous web comprises controlling or decreasing cellulolytic activity in an aqueous fiber suspension or in process water. Said produced fibrous web has increased strength, tensile strength, strain at break, tensile stiffness, tensile energy absorption, breaking length, tear strength, compressive strength (e.g. measured by a SCT (Short-Span Compressive Test)), and optionally said fibrous web is obtained with a method of the present invention. The cellulolytic activity of the fibrous web has been controlled or decreased by controlling or decreasing the cellulolytic activity of the aqueous fiber suspension or process water for preparing the fibrous web. In one embodiment the cellulolytic activity is controlled or decreased to a cellulolytic or cellulase activity level 0-0.1 mU/ml, 0-0.2 mU/ml, 0-0.5 mU/ml or 0-1.0 mU/ml of the aqueous fiber suspension or process water, to a cellulolytic microbe level $0\text{-}1\times10^6$, $0\text{-}1\times10^1$, $0\text{-}1\times10^8$, or $0\text{-}1\times10^9$ microbes in ml of the aqueous fiber suspension or process water, and/or to a cellulolytic microbe level 0-5%, 0-10% or 0-25% of the microbes in the aqueous fiber suspension or process water; or the cellulolytic activity has been decreased at least 5%, e.g. at least 10%, 15%, 20%, 25%, 30%, 35% or 40% (mU/ml of the aqueous fiber suspension or process water) and/or a cellulolytic microbe level at least 5% e.g. at least 10%, 15%, 20%, 25%, 30%, 35% or 40% (microbes in ml of the aqueous fiber suspension or process water).

In one embodiment the increased strength, tensile strength, strain at break, tensile stiffness, tensile energy absorption, breaking length, tear strength, or compressive strength (e.g. measured by a SCT (Short-Span Compressive Test)) refers to at least 1%, 2%, 3%, 4%, 5%, 6%, 7%, 8%, 9%, 10%, 15%, 20%, 30% or 40% increase compared to a fiber web produced without controlling the cellulolytic activity and/or without using one or more biocides to decrease the cellulolytic activity. For example, in the fiber web (final product, such as paper or board) of the present invention tensile strength can be at least 3 kN/m; strain at break at least 1.2 mm or at least 1.3 mm; tensile stiffness at least 470 kN/m or at least 475 kN/m; tensile energy absorption at least 21 $J/m^2$, at least 25 $J/m^2$ or at least 28 $J/m^2$; breaking length at least 3 km; tear strength at least 620 mN, 650 mN or 680 mN; and/or compressive strength at least 1.7 k/m.

Advantages of the present invention are typically evident when measuring tensile strength, tear strength and/or SCT strength (compressive strength, e.g. measured by SCT Short-Span Compressive Test) of the final product, such as paper or board.

In this context, unless otherwise stated, an increase or a decrease of a measured value as a function of a modification is always estimated in view of respective value without said modification but otherwise is respective conditions.

The present invention further concerns an aqueous cellulose fiber suspension or process water for a production method of a fibrous web containing cellulose fibers, wherein said fiber suspension or process water has controlled or decreased cellulolytic activity and said fiber suspension or process water has optionally been obtained with a method of the present invention. In one embodiment the cellulolytic activity is controlled or decreased to a cellulolytic or cellulase activity level 0-0.1 mU/ml, 0-0.2 mU/ml, 0-0.5 mU/ml or 0-1.0 mU/ml of the aqueous fiber suspension or process water, to a cellulolytic microbe level $0\text{-}1\times10^6$, $0\text{-}1\times10^7$, $0\text{-}1\times10^8$, or $0\text{-}1\times10^9$ microbes in ml of the aqueous fiber suspension or process water, and/or to a cellulolytic microbe level 0-5%, 0-10% or 0-25% of the microbes in the aqueous fiber suspension or process water; or the cellulolytic activity has been decreased (in view of non-controlled sample) at least 5%, e.g. at least 10%, 15%, 20%, 25%, 30%, 35% or 40% (mU/ml of the aqueous fiber suspension or process water) and/or a cellulolytic microbe level at least 5% e.g. at least 10%, 15%, 20%, 25%, 30%, 35% or 40% (microbes in ml of the aqueous fiber suspension or process water).

A system of the present invention for controlling cellulolytic activity in an aqueous fiber suspension or in process water comprises one or more biocides and optionally tools and/or instructions for determining cellulase activity in an aqueous fiber suspension or in process water. Non-limiting examples of suitable tools and reagents for determining or measuring cellulolytic or cellulase activity include tools and reagents of commercial kits on market, tools and reagents for enzymatic or protein assays (e.g. suitable enzyme substrates), tools and reagents for immunological detection methods (e.g., antibodies specific for said enzymes or polypeptides), tools and reagents for nucleotide or PCR based assays and sequencing (e.g. qPCR, RT-PCR, next generation sequencing, high throughput sequencing) such as primers or probes (e.g. 16S rRNA primers or probes, or primers or probes for determining cellulases), and any combination thereof. Indeed, tools of the present invention can enable determination of the potential, presence, absence, amount or type of cellulase activity and/or cellulolytic microbes. Also, tools of the present invention include but are not limited to tools for taking samples.

The system of the present invention for controlling cellulolytic activity in an aqueous fiber suspension or in process water can comprise instructions for determining cellulase activity in an aqueous fiber suspension or in process water. E.g. said instructions may include instructions selected from the group consisting of instructions for controlling cellulase activity and/or cellulolytic microbes (e.g. when taking samples, when biocide treatments are needed and when not, what kind of biocide treatments are needed (type, concentration, treatment periods), etc.), instructions for carrying out a method for determining cellulase activity and/or cellulolytic microbes, instructions for taking the samples, instructions for interpreting the results, instructions for carrying out statistical analysis, instructions for one or more biocide treatments, and any combination of said instructions. Optionally instructions may comprise pre-determined values of cellulase activity and/or cellulolytic microbe levels for controlling cellulase activity and/or cellulolytic microbe levels in an aqueous fiber suspension or in process water; and/or suitable values of cellulase activity and/or cellulolytic microbe levels to be obtained for optimal paper or board production method.

It will be obvious to a person skilled in the art that, as the technology advances, that the inventive concept can be implemented in various ways. The invention and its embodiments are not limited to the examples described below but may vary within the scope of the claims.

EXAMPLES

Example 1: Cellulolytic Bacteria are Abundant in Processes Utilizing Recycled Fiber (RCF)

Bacterial quantities and community compositions in RCF suspension and white water (WW) were determined from a set of RCF-utilizing board machines by means of qPCR and Illumina high throughput sequencing of partial 16S rRNA gene. Total bacterial densities were up to $5*10^{10}$ cells/ml process sample. According to sequence classification, surprisingly many of the process bacteria (54-98%) belonged to bacterial phyla with known cellulolytic potential and to bacterial orders with known cellulolytic potential (27-89%) (see e.g., Flint H et al. 2012, Gut Microbes July 1; 3(4): 289-306; López-Mondéjar R et al. 2016, Scientific reports volume 6, article number: 25279; Koeck D et al. 2014, Current Opinion in Biotechnology, 29:171-183, Bergey's Manual of Systematic Bacteriology, $2^{nd}$ Ed., and Silva v. 132 taxonomy) (FIG. 1).

Example 2: Cellulase Activity Measured in RCF Process, Inhibited by Continuous Addition of Biocides For example, in soil research microbial cellulolytic potential can be tested with agar plate cultivation, but there are also commercially available substrates for measurement of cellulase activity directly from aqueous samples (cellulase production organism cultivation broths/extracts). We tested the applicability of one of them, Enzchek Cellulase substrate (Life Technologies, part of Thermo Fisher Scientific), on paper industry process samples with following modifications to the suggested measurement protocol:

- sodium acetate buffer was adjusted to pH 6.0
- samples we diluted 1/10 to minimize inhibition and quenching by fibers According to the supplier, the assay limit of detection is ~110% of the signal for blank (buffer instead of sample). In addition, standard curve was measured as recommended with *Trichoderma* mold cellulase (at recommended pH 5.0), but in addition also with *Bacillus amyloliquefaciens* cellulase (Megazyme; at recommended pH 6.0). Both gave near-linear standard curve with good sensitivity.

Short-term and long-term effect of biocides on cellulase activity of process samples was tested with laboratory incubations of recycled fiber (RCF) pulp samples at 40° C. Table 1 shows that the treatment had decreased culturable total aerobic bacterial counts by 4 orders of magnitude, but biocide (Mixture of DBNPA, Bronopol and CMIT/MIT, totally 20 ppm as active substance+7 ppm Zn) had no immediate impact on cellulase activity, stressing the importance of continuous process control.

TABLE 1

Cellulolytic activity and aerobic bacterial count

| Sample | Cellulase activity at 24 h, % compared to blank | Aerobic bacteria, cfu/ml |
|---|---|---|
| RCF pulp with no treatment | 160 | 350 000 000 |
| RCF pulp with biocide + Zn | 160 | 80 000 |

On the contrary, in a 3-day experiment (Table 2) with daily dosages of oxidative biocide monochloramine (MCA) reduced cellulase activity to the level of the blank (and total CFUs by 5 orders of magnitude), whereas non-treated reference incubation showed 20% higher activity. When the MCA-treated bottle was further incubated for 4 days, and cellulase activity measured 5 d after the last biocide dosage, activities had jumped up to 134% of the blank, corresponding to activity of ~0.2 mU/ml in process sample. These results again stress the importance of continuous process control by regular monitoring of relevant parameters and dosing biocides accordingly.

TABLE 2

Cellulase activity and bacterial count in treated and non-treated pulp

| Sample | Cellulase activity at 3 d, % compared to blank | Aerobic bacteria, 3 d, cfu/ml | Cellulase activity at 7 d, % compared to blank | Aerobic bacteria, 6 d, cfu/ml |
|---|---|---|---|---|
| RCF pulp | 120 | 120 000 000 | — | — |
| RCF pulp with MCA (Day 1 50 mg/l, Day 2 and 3 10 mg/l. Days 4-8, no addition | 100 | 6000 | 134 | 30 000 000 |

Example 3. pH and Redox Drop in Virgin Pulp and in Recycled Fiber

Process water was collected from a mill using recycled fiber. It had high bacterial activity (>$10^7$ cfu/ml). Two 2% pulp suspensions were prepared using this water: 30 g dry virgin birch pulp and recycled fiber (=linerboard from a European packaging board machine using 100% RCF as raw material and about 50 kg/ton starch) was re-pulped with 1.5 liter of process water. After this, pulp samples were incubated at +40° C. with mild shaking. After the incubation, pH and redox values were measured from the pulp suspensions.

Table 3 shows that pH change was bigger in RCF and there was a very big difference in the redox values. These measurements show that the RCF pulp induced clearly higher bacterial activity than virgin fiber pulp.

TABLE 3 pH and ORP in virgin and recycled fiber pulp suspensions

| | pH | | | Redox, mV | | |
|---|---|---|---|---|---|---|
| | at start | 2 days | Change | at start | 2 days | Change |
| Virgin birch pulp | 5.79 | 5.49 | 0.3 | +140 | +70 | −70 |
| Recycled fiber pulp (RCF) | 6.55 | 6.04 | 0.51 | +190 | −350 | −540 |

Example 4. Fiber Strength is Affected by Cellulolytic Activity

Preparation and Treatment of Pulp 50 g liner board was re-pulped with process water from a mill using recycled fiber. The final consistency of the pulp was 1.0% and the liner was from a mill using ~50% unbleached kraft pulp and ~50% recycled fiber. This mill uses about 6 kg/ton wet-end starch in the production of the liner. The pulp suspension was divided into 12 bottles. Six of the bottles were put into an incubator with no other treatment. The other 6 bottles were first pasteurized (1 h, +80° C.) in order to inactivate any enzymes present. After that, the bottles were treated with a combination of a biocide (Mixture of DBNPA, bronopol and CMIT/MIT, 100 mg/l as active substance) and either zinc or zinc comprising compound (25 mg/l as $Zn^{2+}$). After this, all 12 bottles were kept at +40° C. with shaking for 3 days. At the beginning of the incubation, the pH of the pulp was 6.64, redox+160 mV and conductivity 5.46 mS/cm.

Preparation of Handsheets

After 3 d pH, ORP, and total and cellulolytic bacterial amounts were measured from each bottle. The treated samples had significantly lower total and cellulolytic bacterial numbers, higher pH and Redox, and lower conductivity (Tables 4 and 5).

One laboratory handsheet (100 g/m2) was made from the pulp in each bottle (total 6 per testpoint) with Rapid-Koethen sheet former. Formed sheets were dried with vacuum dryer (9300, 10 min). Before testing in the laboratory, sheets were pre-conditioned for 24 h at 23° C. in 50% relative humidity, according to the standard ISO 187. The strength properties were measured according to Table 6. Results show that the grammage of the handsheets was very close to each other and all the strength properties were clearly higher in the treated samples compared to non-treated samples (Table 7). For example, tensile strength was more than 17% and tear strength more than 9% higher in the treated samples. At the same time, ash content was higher in the treated sample, which has also slight decreasing effect on strength.

TABLE 4

Properties of non-treated and treated RCF-pulp samples after 3 d incubation.

| | non-treated samples, n = 6 | | treated samples, n = 6 | |
|---|---|---|---|---|
| | Average | St. dev. | Average | St. dev. |
| Aerobic bacteria, cfu, ml | 67 500 000 | 11 000 000 | 57 000 | 14 000 |
| Anaerobic bacteria, cfu/ml | 450 000 | 130 000 | 7300 | 4000 |
| pH | 6.04 | 0.03 | 6.44 | 0.02 |
| Redox, mV | 18 | 4 | 159 | 20 |
| Conductivity, mS/cm | 5.90 | 0.01 | 5.66 | 0.01 |

TABLE 5

Amounts of cellulolytic bacterial taxa (phyla, orders) in non-treated and treated RCF-pulp samples after 3 d incubation.

| | | Non-treated | | Treated | |
|---|---|---|---|---|---|
| | | Bottles 1-3 | Bottles 4-6 | Bottles 7-9 | Bottles 10-12 |
| cells/ml (phylum) | Actinobacteria | 7E+06 | 7E+06 | 2E+04 | 2E+04 |
| | *Bacteroidetes* | 4E+08 | 3E+08 | 3E+05 | 4E+05 |
| | Firmicutes | 2E+08 | 2E+08 | 2E+05 | 4E+05 |
| cells/ml (order) | Corynebacteriales | 5E+06 | 4E+06 | 1E+03 | 1E+04 |
| | Micrococcales | 1E+06 | 2E+06 | 6E+03 | 3E+03 |
| | Bacteroidales | 6E+07 | 5E+07 | 6E+04 | 8E+04 |
| | Bacillales | 6E+07 | 6E+07 | 9E+04 | 1E+05 |
| | Lactobacillales | 1E+08 | 8E+07 | 8E+04 | 2E+05 |
| | Clostridiales | 9E+06 | 8E+06 | 6E+04 | 8E+04 |
| | Thermoanaerobacterales | 4E+07 | 3E+07 | 1E+04 | 3E+03 |
| | Betaproteobacteriales | 3E+07 | 3E+07 | 4E+04 | 3E+04 |
| | Xanthomonadales | 1E+08 | 9E+07 | 6E+04 | 9E+04 |

TABLE 6

Sheet testing devices and standard methods used for produced paper sheets.

| Measurement | Device | Standard |
|---|---|---|
| Basis weight | Mettler Toledo | ISO 536 |
| Tear Strength | Lorentzen & Wettre | ISO 1974 |
| Tensile Strength | Lorentzen & Wettre | ISO 1924-3 |
| Short span compression Test (SCT) | Lorentzen & Wettre | ISO 9895 |

TABLE 7

The strength properties of the handsheet prepared from treated and non-treated pulps.

| | non-treated | treated |
|---|---|---|
| Grammage, g/m$^2$ | 65.3 | 65.6 |
| Ash content, % | 2.6 | 4.4 |
| Tensile index, Nm/g | 30.72 | 36.19 |
| Tear index, Nm$^2$/kg | 6.76 | 7.38 |

Example 5. Retained Fiber Strength, and Lower Cellulase Activity, by Inhibited Bacterial Activity Preparation and Treatment of Pulp 50 g liner board (from two different mills: 50% from a mill using ~50% unbleached kraft pulp and ~50% recycled fiber and 50% from a mill using 100% recycled fiber) was re-pulped with process water from a third mill using recycled fiber. The final consistency of the pulp was 1.0%. The pulp suspension was divided into 12 bottles and starch suspension (native potato starch) was added into each bottle, so that the concentration of added starch was 1.5 g/l. Six of the bottles (numbers 1-6) were put into an incubator with no other treatment. The other 6 bottles (numbers 7-12) were first pasteurized (1 h, +80° C.) in order to inactivate any enzymes present. After that, the bottles were treated with a biocide (50 mg/l monochloramine, as active chlorine). After this, all 12 bottles were kept at +40° C. with shaking for 4 days. During the incubation, 10 mg/l monochloramine was added daily into the bottles 7-12). At the beginning of the incubation, the pH of the pulp was 6.0, redox −46 mV and conductivity 4.8 mS/cm.

Preparation of Handsheets

After 2 d, ATP was measured from each bottle and was 1000-fold higher in non-treated than treated bottles (average 71 000 pg/ml, st.dev. 3800, vs. average 70, st.dev. 7 pg/ml, respectively).

After 4 d pH, ORP, bacterial amounts and cellulase activity were measured from each bottle. The treated samples had notably lower bacterial numbers and cellulase activity, but higher pH and Redox (Table 8).

One laboratory handsheets was made from the pulp in each bottle. After the handsheets were made, the strength properties were measured according to Table 9. The grammage of the handsheets was very close to each other. Instead, the strength properties were clearly better in the treated samples. For example, tensile strength was about 12% better in the treated sample, tear strength more than 9% and SCT about 3.5% higher. At the same time, ash content was about 8.8% higher in the treated sample, which is decreasing strength.

TABLE 8

Properties of treated and non-treated RCF-pulp samples after 4 d incubation.

| | non-treated samples, n = 6 | | treated samples, n = 6 | |
|---|---|---|---|---|
| | Average | St. dev. | Average | St. dev. |
| Aerobic bacteria, cfu, ml | 120 000 000 | 17 000 000 | 8 700 | 3 300 |
| Anaerobic bacteria, cfu/ml | 37 000 000 | 6 600 000 | 970 | 2 000 |
| Cellulase activity mU/ml | 1.01 | 0.15 | 0.44 | 0.08 |
| pH | 5.8 | 0.0 | 6.3 | 0.0 |
| Redox, mV | −459 | 23 | 94 | 10 |

TABLE 9

The properties of the handsheet prepared from treated and non-treated pulps.

| | non-treated | treated |
|---|---|---|
| Grammage, g/m$^2$ | 98.47 | 99.81 |
| Ash content, % | 4.00 | 4.35 |
| Tensile index, Nm/g | 27.62 | 30.92 |
| SCT index, Nm/g | 16.58 | 17.16 |
| Tear index, Nm$^2$/kg | 6.23 | 6.84 |

The invention claimed is:

1. A method of monitoring and controlling cellulolytic activity in an aqueous cellulose fiber suspension or process water for a production method of a fibrous web containing cellulose fibers, wherein the method comprises determining cellulolytic activity in the aqueous cellulose fiber suspension comprising recycled cellulose fibers or process water for the production method of the fibrous web containing recycled cellulose fibers, comparing the determined cellulolytic activity to a pre-determined cellulolytic activity value, and controlling cellulolytic activity by treating the aqueous cellulose fiber suspension or process water with one or more biocides one or more times if the determined cellulolytic activity is above the pre-determined cellulolytic activity value.

2. The method of claim 1, wherein determining cellulolytic activity comprises determining cellulolytic activity of a sample obtained from the aqueous cellulose fiber suspension or the process water.

3. The method of claim 1, wherein determining cellulolytic activity comprises determining cellulolytic or cellulase activity, cellulases, and/or cellulolytic microbes in the aqueous fiber suspension or the process water.

4. The method of claim 3, wherein cellulolytic microbes are determined with a nucleic acid-based method.

5. The method of claim 1, wherein the cellulolytic activity is determined before an inlet of an intermediate residence entity, in the intermediate residence entity, and/or after an outlet of an intermediate residence entity.

6. The method of claim 1, wherein the cellulolytic activity is microbial or bacterial cellulolytic activity.

7. The method of claim 6, wherein cellulolytic microbe(s) is (are) selected from the group consisting of bacterial phyla Actinobacteria, Bacteroidetes, Firmicutes, orders Corynebacteriales, Micrococcales, Bacteroidales, Bacillales, Lactobacillies, Clostridiales, Thermoanaerobacterales, Betaproteobacteriales, Xanthomonadales, and any family or genus belonging to said phyla or orders.

8. The method of claim 1, wherein the cellulolytic activity is controlled to a cellulolytic or cellulase activity level 0-1.0 mU/ml of the aqueous fiber suspension or process water, to a cellulolytic microbe level 0-1×$10^9$ microbes in ml of the aqueous fiber suspension or process water, and/or to a cellulolytic microbe level 0-25% of the total microbes in the aqueous fiber suspension or process water; or the cellulolytic activity is controlled by decreasing a cellulolytic or cellulase activity at least 5% (mU/ml of the aqueous fiber suspension or process water) and/or a cellulolytic microbe level at least 5% (microbes in ml of the aqueous fiber suspension or process water).

9. The method of claim 1, wherein the cellulolytic activity is controlled for improving or maintaining the strength of fibers or the fibrous web.

10. The method of claim 1, wherein the aqueous fiber suspension is in or from an intermediate residence entity with a delay time of 1-48 hours.

11. The method of claim 1, wherein the consistency of the aqueous fiber suspension in an intermediate residence entity is at least 2 g/l.

12. The method of claim 1, wherein the aqueous fiber suspension comprises recycled fibers or the fibers of the aqueous fiber suspension are recycled fibers.

13. The method of claim 1, wherein the one or more biocides are selected from oxidizing biocides and non-oxidizing biocides.

14. The method of claim 1, wherein the one or more biocides is a non-oxidizing biocide selected from the group consisting of: 2,2-Dibromo-3-nitrilopropionamide (DBNPA); 2-Bromo-2-nitropropane-1,3-diol (Bronopol); 2-Bromo-2-nitro-propan-1-ol (BNP); 2,2-Dibromo-2-cyano-N-(3-hydroxypropyl) acetamide; 2,2-Dibromomalonamide; 1,2-Dibromo-2,4-dicyanobutane (DCB); Bis(trichloromethyl) sulfone; 2-Bromo-2-nitrostyrene (BNS); Didecyl-dimethylammonium chlorine (DDAC); ADBAC and other quaternary ammonium compounds; 3-Iodopropynyl-N-butylcarbamate (IPBC); Methyl and Dimethylthiocarbamates and their salts; 5-Chloro-2-methyl-4-isothiazolin-3-one (CMIT); 2-Methyl-4-isothiazolin-3-one (MIT) and their mixture; 2-n-Octyl-4-isothiazolin-3-one (OIT); 4,5-Dichloro-2-(n-octyl)-3 (2H)-isothiazolone (DCOIT); 4,5-Dichloro-1,2-dithiol-3-one; 1,2-Benzisothiazolin-3-one (BIT); 2-(Thiocyanomethylthio)benzthiazole (TCMBT); 2-Methyl-1,2-benzisothiazolin-3 (2H)-one (MBIT); Tetrakis hydroxymethyl phosphonium sulfate (THPS); Tetrahydro-3,5-dimethyl-2H-1,3,5-thiadiazine-2-thione (Dazomet); Methylene bisthiocyanate (MBT); Orthophenylphenol (OPP) and its salts; Glutaraldehyde; Ortho-phthaldehyde (OPA); Guanidines and biguanidines; N-dodecylamine or n-dodecylguanidine; dodecylamine salt or dodecylguanidine salt; Bis-(3-aminopropyl) dodecylamine; Pyrithiones; Triazines; 3-[(4-Methylphenyl) sulfonyl]-2-propenenitrile; 3-Phenylsulphonyl-2-propenenitrile; 3-[(4-trifluormethylphenyl)sulphonyl]-2-propenenitrile; 3-[(2,4,6-trimethylphenyl)sulphonyl]-2-propenenitrile; 3-(4-methoxyphenyl)sulphonyl-2-propenenitrile; 3-[(4-methylphenyl)sulphonyl]prop-2-enamide; any of their isomers; and any combination thereof; and/or the one or more biocides is an oxidizing biocide and selected from the group consisting of: chlorine; alkali and alkaline earth hypochlorite salts; hypochlorous acid; bromine; alkali and alkaline earth hypobromite salts; hypobromous acid; chlorine dioxide; ozone; hydrogen peroxide; peroxy compounds; halogenated hydantoins; dihalodimethylhydantoins; perhalogenated hydantoins; monochloramines; monobromamines; dihaloamines; trihaloamines; urea reacted with an oxidant; and ammonium salts reacted with an oxidant.

15. The method of claim 14, wherein the at least one of the one or more biocides is a non-oxidizing biocide selected from the group consisting of: dodecylguanidine hydrochloride; Zinc pyrithione; Hexahydro-1,3,5-trimethyl-1,3,5-triazine; and combinations thereof, and/or wherein the at least one of the at least one biocides is an oxidizing biocide selected from the group consisting of: performic acid; peracetic acid; percarbonate, persulfate;

monohalodimethylhydantoins; urea reacted with an oxidant, the oxidant being alkali and alkaline earth hypochlorite salts or alkali and alkaline earth hypobromite salts; ammonium bromide, ammonium sulfate or ammonium carbamate, reacted with an oxidant, the oxidant being alkali and alkaline earth hypochlorite salts or alkali and alkaline earth hypobromite salts, and combinations thereof.

16. The method of claim 1, wherein the aqueous cellulose fiber suspension or process water is treated with a combination of the one or more biocides and zinc ions.

17. A method of manufacturing a fibrous web, wherein the method comprises forming an aqueous fiber suspension comprising recycled cellulosic fibers from one or more raw material flows and/or process water, determining cellulolytic activity of the aqueous cellulose fiber suspension, raw material flow and/or process water, comparing the determined cellulolytic activity to a predetermined cellulolytic activity value, controlling cellulolytic activity by treating the aqueous cellulose fiber suspension or process water with one or more biocides one or more times if the determined cellulolytic activity is above the pre-determined cellulolytic activity value, and forming the aqueous cellulose fiber suspension into a fibrous web and drying the fibrous web.

18. The method of claim 17, wherein the fibrous web comprises a paper, board, or tissue.

* * * * *